US012134833B2

(12) United States Patent
Seki et al.

(10) Patent No.: US 12,134,833 B2
(45) Date of Patent: Nov. 5, 2024

(54) PLATING APPARATUS AND CLEANING METHOD OF CONTACT MEMBER OF PLATING APPARATUS

(71) Applicant: EBARA CORPORATION, Tokyo (JP)

(72) Inventors: Masaya Seki, Tokyo (JP); Masaki Tomita, Tokyo (JP); Shao Hua Chang, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 207 days.

(21) Appl. No.: 17/764,454

(22) PCT Filed: Mar. 17, 2021

(86) PCT No.: PCT/JP2021/010779
§ 371 (c)(1),
(2) Date: Mar. 28, 2022

(87) PCT Pub. No.: WO2022/195756
PCT Pub. Date: Sep. 22, 2022

(65) Prior Publication Data

US 2023/0340687 A1 Oct. 26, 2023

(51) Int. Cl.

| | |
|---|---|
| ***C25D 21/08*** | (2006.01) |
| ***C25D 17/00*** | (2006.01) |
| ***C25D 17/06*** | (2006.01) |
| ***C25D 21/10*** | (2006.01) |
| ***C25D 21/12*** | (2006.01) |

(52) U.S. Cl.
CPC ..... *C25D 21/08* (2013.01); *C25D 17/005* (2013.01); *C25D 17/06* (2013.01); *C25D 21/10* (2013.01); *C25D 21/12* (2013.01)

(58) Field of Classification Search
CPC ..... C25D 21/08; C25D 21/12; C25D 21/00
See application file for complete search history.

(56) References Cited

U.S. PATENT DOCUMENTS

| | | | | |
|---|---|---|---|---|
| 2006/0058730 | A1 | 3/2006 | Pratt et al. | |
| 2013/0061875 | A1 | 3/2013 | Woodruff | |
| 2013/0174873 | A1* | 7/2013 | Yoshihara | B08B 5/02 134/21 |
| 2013/0292254 | A1 | 11/2013 | Kumar et al. | |
| 2017/0056934 | A1 | 3/2017 | Wang et al. | |

FOREIGN PATENT DOCUMENTS

| | | | |
|---|---|---|---|
| JP | 2008-19496 | A | 1/2008 |

* cited by examiner

*Primary Examiner* — Natasha N Campbell
(74) *Attorney, Agent, or Firm* — BakerHostetler

(57) ABSTRACT

A plating apparatus 1000 includes a plating tank, a substrate holder 20, a rotation mechanism, an elevating mechanism, a contact member 40, and a cleaning device 50 configured to clean the contact member 40. The cleaning device 50 includes a pivot shaft 51, a first arm 53, a second arm 54, and a nozzle 55 that includes at least one discharge port. Applying a cleaning fluid discharged from the discharge port to the contact member 40 cleans the contact member 40.

8 Claims, 10 Drawing Sheets

1000

(B1-B1)

PLATING APPARATUS AND CLEANING METHOD OF CONTACT MEMBER OF PLATING APPARATUS

TECHNICAL FIELD

The present invention relates to a plating apparatus and a cleaning method of a contact member of the plating apparatus.

BACKGROUND ART

Conventionally, there has been known what is called a cup type plating apparatus as a plating apparatus that can perform a plating process on a substrate (for example, see PTL 1). The plating apparatus includes a plating tank, a substrate holder disposed above an anode disposed inside the plating tank to hold the substrate as a cathode, and a rotation mechanism that rotates the substrate holder.

A contact member for supplying electricity to the substrate is generally disposed on the substrate holder of the above-described conventional plating apparatus. When this contact member gets dirty, a resistance value of the contact member changes and plating quality of the substrate possibly deteriorates. Therefore, a technique regarding a cleaning device that can clean this contact member has been developed (for example, see PTL 2).

CITATION LIST

Patent Literature

PTL 1: Japanese Unexamined Patent Application Publication No, 2008-19496

PTL 2: US Patent Application Publication No. 2013/0061875

SUMMARY OF INVENTION

Technical Problem

However, the conventional cleaning device of the contact member as described above had a complicated structure.

The present invention has been made in view of the above-described matter, and one of the objects is to provide a technique that can clean a contact member with a simple structure.

Solution to Problem (Aspect 1) To achieve the above object, a plating apparatus according to one aspect of the present invention includes a plating tank, a substrate holder, a rotation mechanism, an elevating mechanism, a contact member, and a cleaning device. The substrate holder is disposed above an anode disposed inside the plating tank. The substrate holder is configured to hold a substrate as a cathode. The rotation mechanism is configured to rotate the substrate holder. The elevating mechanism is configured to raise and lower the substrate holder. The contact member is disposed on the substrate holder. The contact member is in contact with an outer peripheral edge of a lower surface of the substrate to supply electricity to the substrate. The cleaning device is configured to clean the contact member. The cleaning device includes a pivot shaft, a first arm, a second arm, and a nozzle. The pivot shaft is disposed in an outer region in a radial direction of the substrate holder and extends in a vertical direction. The first arm is connected to the pivot shaft and extends in a horizontal direction. The second arm extends upward from an end portion on a side opposite to a side connected to the pivot shaft of the first arm. The nozzle is connected to an upper end of the second arm and includes at least one discharge port that is open downward, and discharges a cleaning fluid. The cleaning device is configured to clean the contact member by applying the cleaning fluid discharged from the discharge port to the contact member.

According to this aspect, the cleaning device having a simple structure including the above-described pivot shaft, first arm, second arm, and nozzle can clean the contact member.

Additionally, according to this aspect, with the two arms, the first arm and the second arm, the nozzle can be disposed at a position farther from a connection position of the first arm in the pivot shaft. This allows effectively cleaning the contact member. Moreover, according to this aspect, since turning the pivot shaft allows moving (turning movement) the nozzle, a cleaned part with the cleaning fluid can be easily changed. This allows the contact member to be easily cleaned in a wide range.

(Aspect 2) In the aspect 1, the nozzle may have a starting point at the upper end of the second arm and extend toward a side of the pivot shaft. An angle formed by an axis line extending in a longitudinal direction of the nozzle and an axis line extending in a longitudinal direction of the first arm in plan view may be 10 degrees or more and 70 degrees or less.

According to this aspect, it is possible to easily apply the cleaning fluid discharged from the discharge port of the nozzle to the contact member. This allows effectively cleaning the contact member.

(Aspect 3) The aspect 1 or 2 may further include a control module. The control module may be configured to control the rotation mechanism, the elevating mechanism, and the cleaning device. When performing a contact member cleaning process that cleans the contact member, the control module may: turn the pivot shaft to move the nozzle that has moved to the outer region in the radial direction of the substrate holder to an elevating position where the nozzle does not interfere with the substrate holder in an inner region in the radial direction of the substrate holder, subsequently lower the substrate holder by the elevating mechanism to locate the contact member below the discharge port, subsequently turn the pivot shaft to move the nozzle to a cleaning position where the discharge port is opposed to the contact member in the inner region, and subsequently discharge the cleaning fluid from the discharge port while rotating the substrate holder by the rotation mechanism.

(Aspect 4) In the aspect 3, during discharging the cleaning fluid from the discharge port while the substrate holder is rotated by the rotation mechanism, the control module may alternately turn the pivot shaft in a first rotation direction and a second rotation direction opposite to the first rotation direction. According to this aspect, the contact member can be effectively cleaned.

(Aspect 5) In any one aspect of the aspects 1 to 4, the second arm may be connected to the end portion of the first arm to be inclinable around a part connected to the first arm in the second arm. According to this aspect, a discharge direction of the cleaning fluid from the discharge port of the nozzle can be easily adjusted.

(Aspect 6) In any one aspect of the aspects 1 to 5, the at least one discharge port may include a plurality of discharge ports. Kinds of the cleaning fluids discharged from the respective discharge ports may be mutually different.

(Aspect 7) In any one aspect of the aspects 1 to 6, the nozzle may further include a suction port that is open downward and suctions a fluid.

According to this aspect, the cleaning fluid after cleaning attached to the contact member can be suctioned from the suction port. Thus, it is possible to suppress leaving the cleaning fluid after cleaning on the contact member over a long period of time, and therefore the contact member can be in a clean state early.

(Aspect 8) In any one aspect of the aspects 1 to 7, the substrate holder may include a first holding member and a second holding member. The first holding member may hold an upper surface of the substrate. The second holding member may hold the outer peripheral edge of the lower surface of the substrate. The contact member may be disposed on the second holding member.

(Aspect 9) To achieve the above object, in a cleaning method of a contact member of a plating apparatus according to one aspect of the present invention, the plating apparatus includes a plating tank, a substrate holder, a contact member, and a cleaning device. The substrate holder is disposed above an anode disposed inside the plating tank. The substrate holder is configured to hold a substrate as a cathode. The contact member is disposed on the substrate holder. The contact member is in contact with an outer peripheral edge of a lower surface of the substrate to supply electricity to the substrate. The cleaning device is configured to clean the contact member. The cleaning device includes a pivot shaft, a first arm, a second arm, and a nozzle. The pivot shaft is disposed in an outer region in a radial direction of the substrate holder and extends in a vertical direction. The first arm is connected to the pivot shaft and extends in a horizontal direction. The second arm extends upward from an end portion on a side opposite to a side connected to the pivot shaft of the first arm. The nozzle is connected to an upper end of the second arm. The nozzle includes at least one discharge port that is open downward and discharges a cleaning fluid. The cleaning method of the contact member includes: turning the pivot shaft to move the nozzle that has moved to the outer region in the radial direction of the substrate holder to an elevating position where the nozzle does not interfere with the substrate holder in an inner region in the radial direction of the substrate holder, subsequently lowering the substrate holder to locate the contact member below the discharge port, subsequently turning the pivot shaft to move the nozzle to a cleaning position where the discharge port is opposed to the contact member in the inner region, and subsequently discharging the cleaning fluid from the discharge port while rotating the substrate holder.

According to this aspect, the cleaning device constituted in the simple structure can clean the contact member.

DESCRIPTION OF EMBODIMENTS

The following describes embodiments of the present invention with reference to the drawings. Furthermore, the drawings are schematically illustrated for ease of understanding features of matters, and a dimensional proportion of each component or the like is not always identical to that of an actual component. For some drawings, X-Y-Z orthogonal coordinates are illustrated for reference purposes. Of the X-Y-Z orthogonal coordinates, the Z direction corresponds to the upper side, and the −Z direction corresponds to the lower side (the direction where gravity acts).

Figure 1:
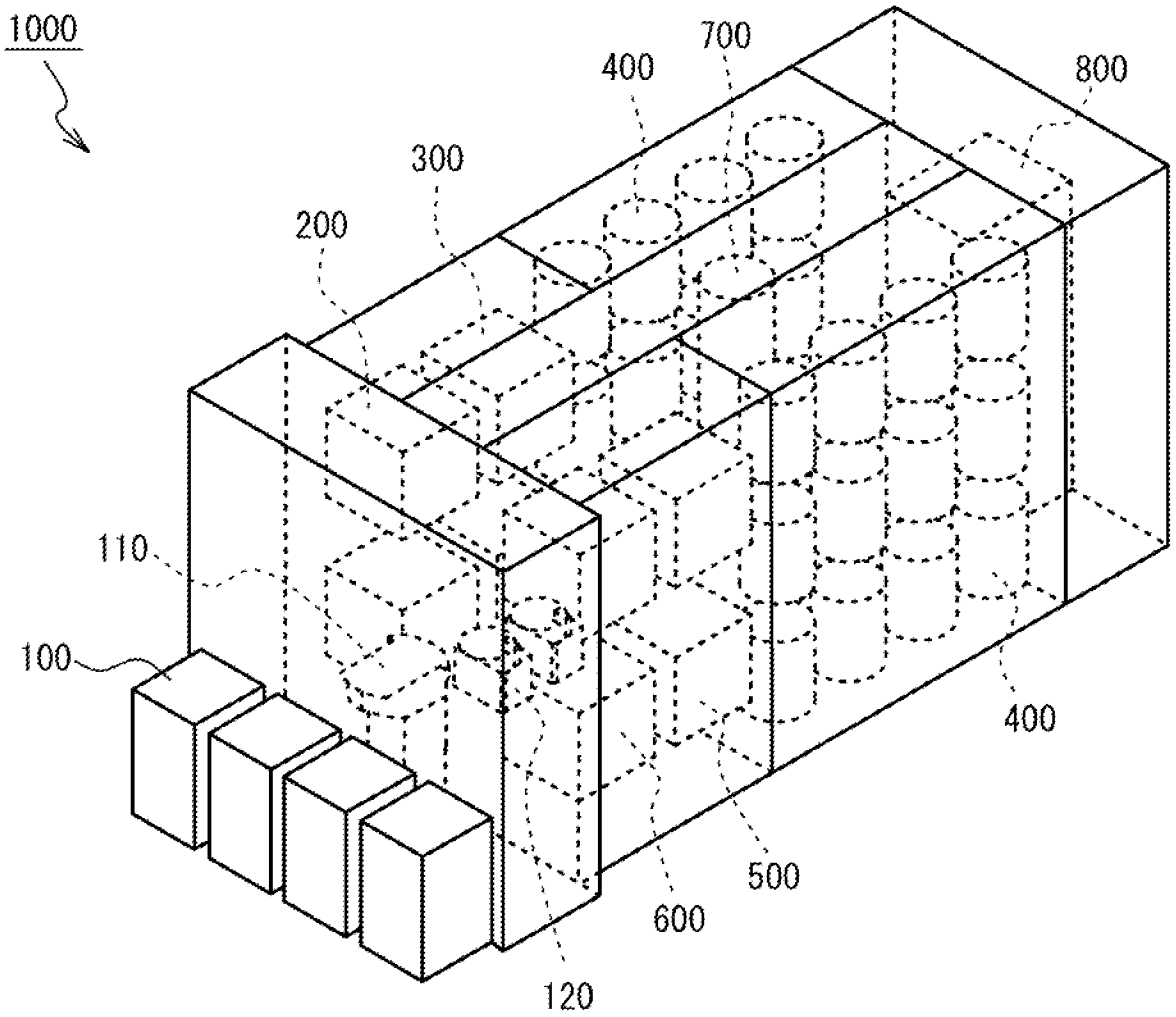
FIG. 1 is a perspective view illustrating an overall configuration of a plating apparatus according to an embodiment.
Figure 2:
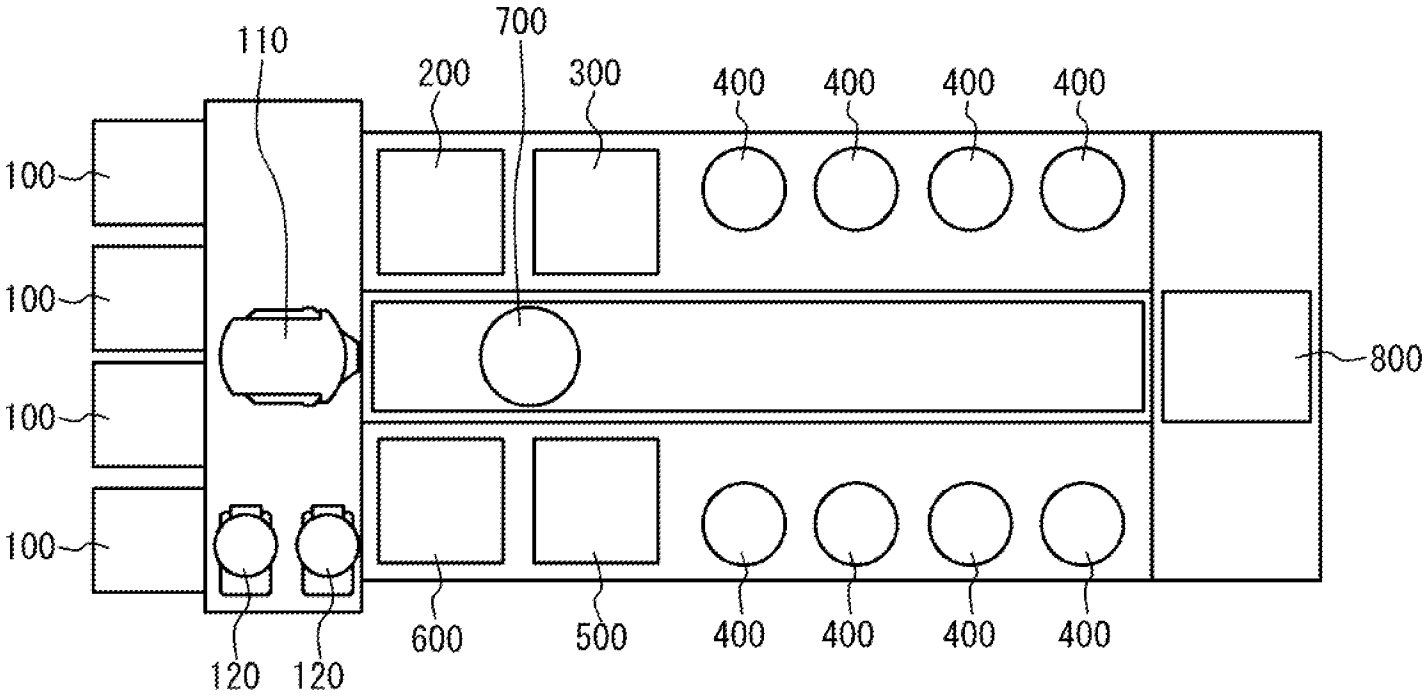
FIG. 2 is a plan view illustrating the overall configuration of the plating apparatus according to the embodiment.

FIG. 1 is a perspective view illustrating the overall configuration of a plating apparatus 1000 of this embodiment. FIG. 2 is a plan view illustrating the overall configuration of the plating apparatus 1000 of this embodiment. As illustrated in FIGS. 1 and 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers 600 are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200, The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configuration of the plating apparatus 1000 described in FIG. 1 and FIG. 2 is merely an example, and the configuration of the plating apparatus 1000 is not limited to the configuration in FIG. 1 or FIG. 2.

Next, the plating modules 400 will be described. Since the plurality of plating modules 400 included in the plating apparatus 1000 according to this embodiment have the identical configuration, only one of the plating modules 400 will be described.

Figure 3:
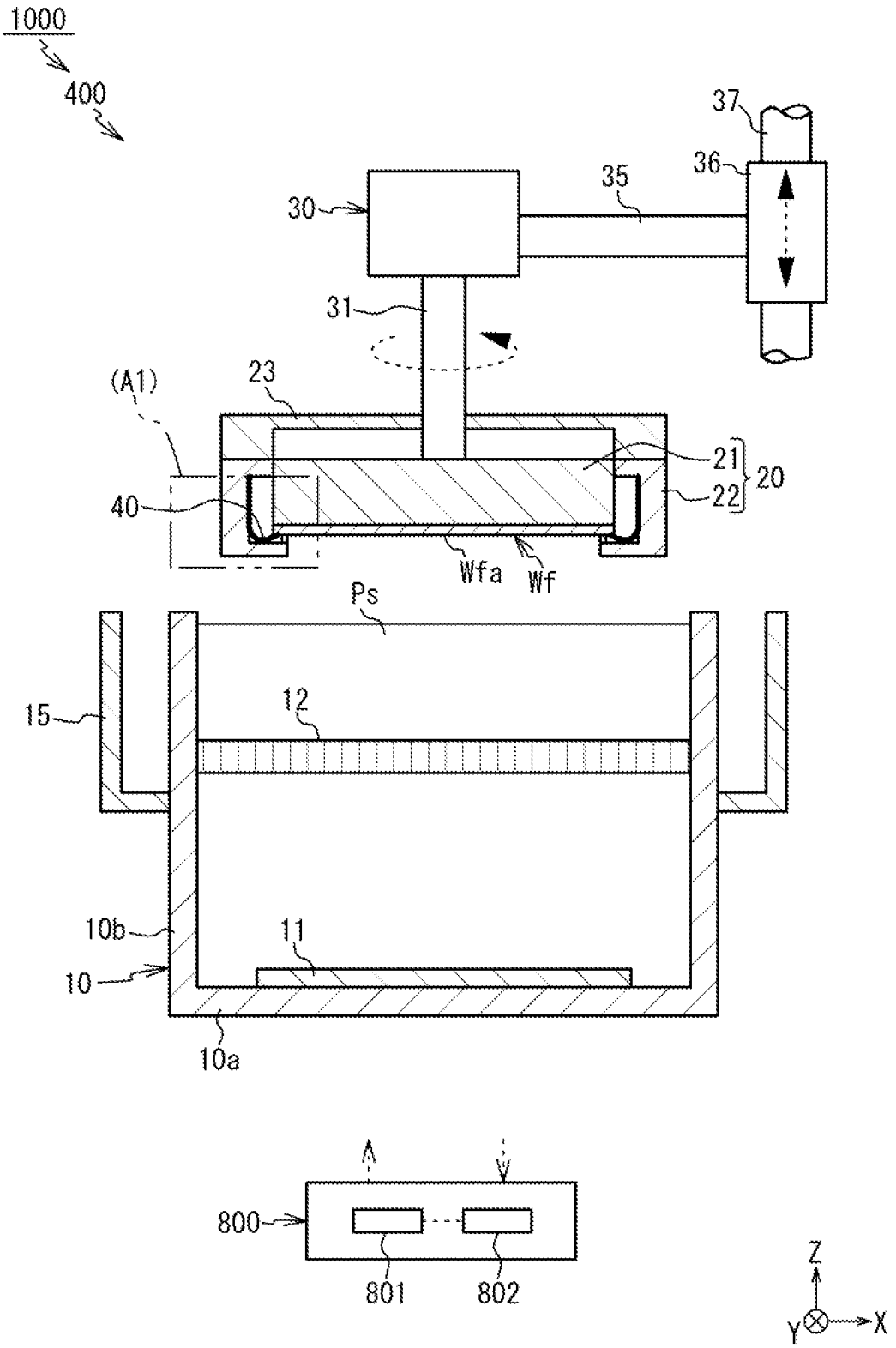
FIG. 3 is a schematic diagram of a configuration of a plating module in the plating apparatus according to the embodiment.
Figure 4:
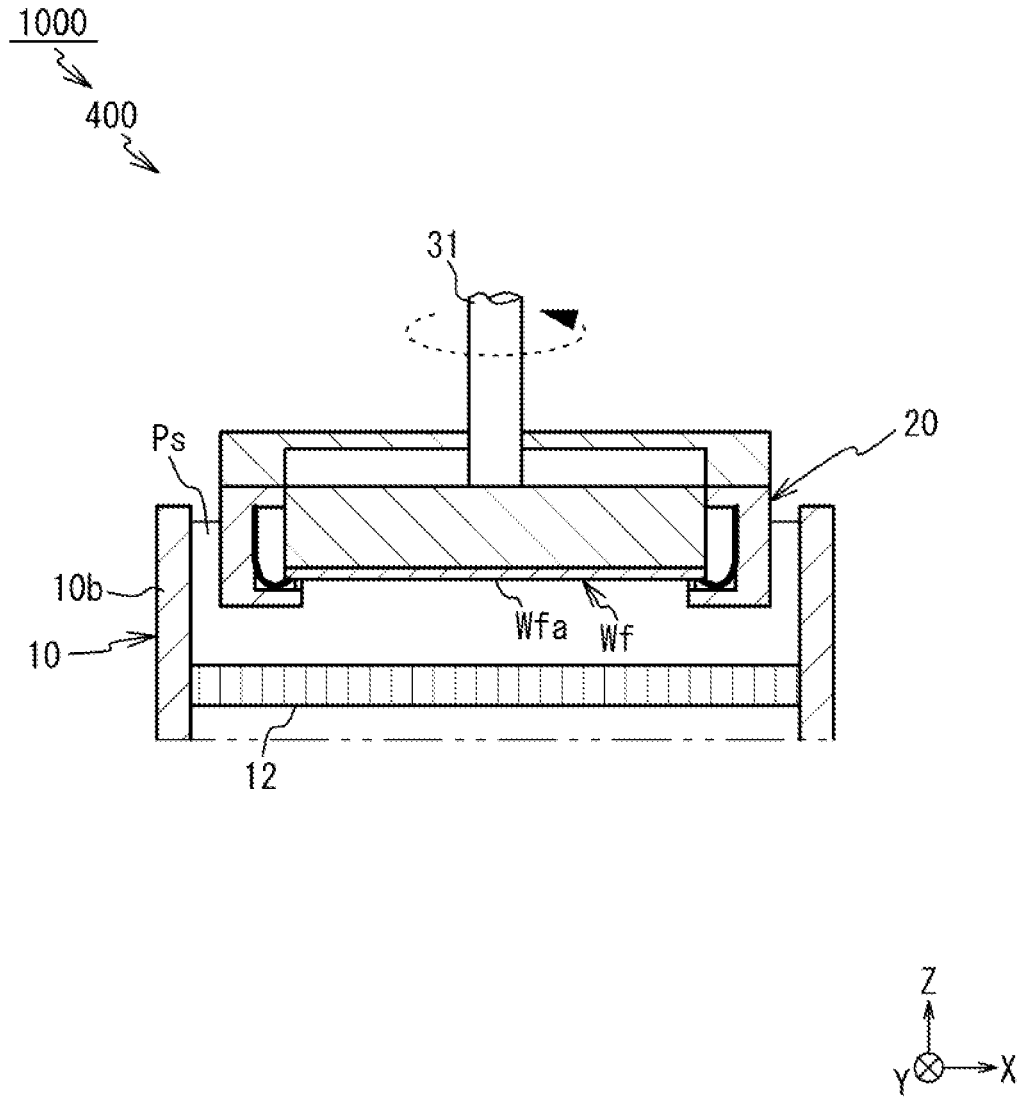
FIG. 4 is a schematic diagram illustrating a state of a substrate according to the embodiment immersed in a plating solution.

FIG. 3 is a schematic diagram of the configuration of the plating module 400 in the plating apparatus 1000 according to this embodiment. FIG. 4 is a schematic diagram illustrating a state of a substrate Wf immersed in a plating solution Ps. The plating apparatus 1000 according to this embodiment is a cup type plating apparatus. The plating module 400 of the plating apparatus 1000 mainly includes a plating tank 10, an overflow tank 15, a substrate holder 20, a rotation mechanism 30, an inclination mechanism 35, an elevating mechanism 36, and contact members 40. Although the plating module 400 also includes a cleaning device 50 (for example, FIG. 6) described later, FIG. 3 and FIG. 4 omit the illustration of the cleaning device 50. FIG. 3 schematically illustrates cross-sectional surfaces of a part of the configurations of the plating module 400 (for example, the plating tank 10, the overflow tank 15, and the substrate holder 20).

The plating tank 10 according to this embodiment is configured by a container with a bottom having an opening on an upper side. Specifically, the plating tank 10 has a bottom portion 10*a* and an outer peripheral portion 10*b* extending upward from an outer peripheral edge of the bottom portion 10*a*, and an upper portion of the outer peripheral portion 10*b* is open. Note that, although the shape of the outer peripheral portion 10*b* of the plating tank 10 is not particularly limited, the outer peripheral portion 10*b* according to this embodiment has a cylindrical shape as an example.

The plating tank 10 internally stores the plating solution Ps. The plating tank 10 includes a supply port (not illustrated) for supplying the plating tank 10 with the plating solution Ps, it is only necessary that the plating solution Ps is a solution that contains metallic element ions for constituting a plating film, and the specific examples are not particularly limited. In this embodiment, a copper plating process is used as an example of the plating process, and a copper sulfate solution is used as an example of the plating solution Ps. Furthermore, in this embodiment, the plating solution Ps contains a predetermined additive. However, it is not limited to this configuration, and the plating solution Ps can have a configuration that does not contain the additive.

The plating tank 10 internally includes an anode 11 in the plating solution Ps. A specific type of the anode 11 is not particularly limited, and a soluble anode and; or an insoluble anode can be used. In this embodiment, an insoluble anode is used as the anode 11. A specific type of this insoluble anode is not particularly limited, and platinum, iridium oxide, and the like can be used.

The overflow tank 15 is disposed in an outer region in a radial direction of the plating tank 10 and configured by a container with a bottom. The overflow tank 15 is a tank disposed for temporarily storing the plating solution Ps that flows over an upper end of the outer peripheral portion 10*b* of the plating tank 10 (that is, the plating solution Ps that has overflowed from the plating tank 10). The overflow tank 15 includes a discharge port (not illustrated) for discharging the plating solution Ps in the overflow tank 15 from the overflow tank 15. After the plating solution Ps is discharged from the discharge port, the plating solution Ps is temporarily stored in a reservoir tank (not illustrated) and then is supplied from the supply port to the plating tank 10 again.

A porous ionically resistive element 12 is disposed above the anode 11 inside the plating tank 10. The ionically resistive element 12 is configured by a porous plate member with a plurality of holes (pores). The plating solution Ps below the ionically resistive element 12 can pass through the ionically resistive element 12 and then flow above the ionically resistive element 12. This ionically resistive element 12 is a member disposed for achieving uniformity of an electric field formed between the anode 11 and the substrate Wf. Thus, since the plating apparatus 1000 includes the ionically resistive element 12, uniformity of a film thickness of a plating film (a plating layer) formed on the substrate Wf can be easily achieved.

The substrate holder 20 is a member for holding the substrate Wf as the cathode. A lower surface Wfa of the substrate Wf is equivalent to the surface to be plated. The substrate holder 20 is connected to a rotation shaft 31 of the rotation mechanism 30. The rotation mechanism 30 is a mechanism for rotating the substrate holder 20, As the rotation mechanism 30, the known mechanism, such as a motor, can be used.

The inclination mechanism 35 is a mechanism for inclining the rotation mechanism 30 and the substrate holder 20. As the inclination mechanism 35, the known inclination mechanism, such as a piston-cylinder, can be used. The elevating mechanism 36 is supported by a spindle 37 extending in the vertical direction. The elevating mechanism 36 is a mechanism for vertically raising and lowering the substrate holder 20, the rotation mechanism 30, and the inclination mechanism 35. As the elevating mechanism 36, the known elevating mechanism, such as a linear motion actuator, can be used.

As illustrated in FIG. 4, to perform the plating process on the lower surface Wfa (the surface to be plated) of the substrate Wf, the rotation mechanism 30 rotates the substrate holder 20 and the elevating mechanism 36 moves the substrate holder 20 downward to immerse the substrate Wf in the plating solution Ps in the plating tank 10, Note that, to immerse the substrate Wf in the plating solution Ps, the inclination mechanism 35 may incline the substrate holder 20 as necessary. After the substrate Wf is immersed in the plating solution Ps, an energization device (not illustrated) flows electricity between the anode 11 and the substrate Wf. This forms the plating film on the lower surface Wfa of the substrate Wf.

An operation of the plating module 400 is controlled by the control module 800. The control module 800 includes a microcomputer, and this microcomputer includes a CPU (Central Processing Unit) 801 as a processor, a storage section 802 as a non-transitory storage medium, and the like. In the control module 800, the CPU 801 as the processor operates to control a controlled section of the plating module 400 based on a command of a program stored in the storage section 802.

Figure 5A:
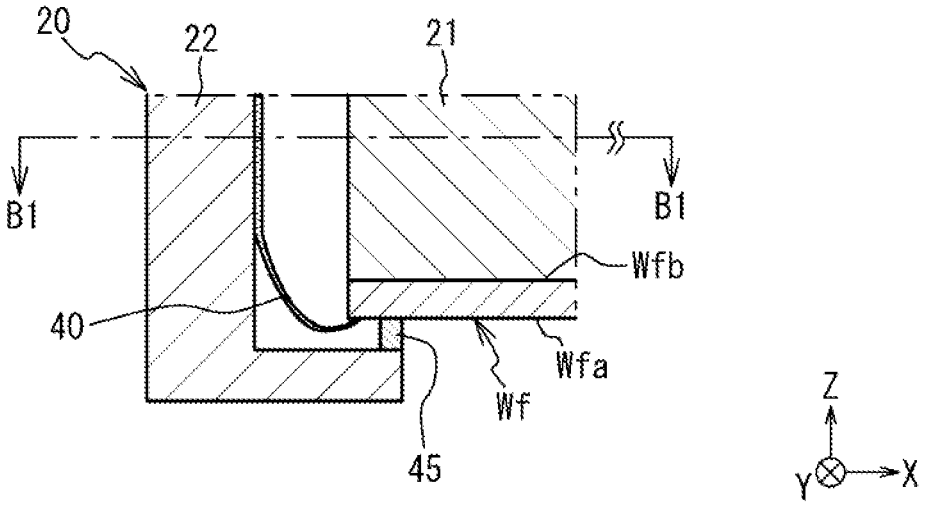
FIG. 5A is a cross-sectional view schematically illustrating a part of an enlarged substrate holder according to the embodiment.

FIG. 5A is a cross-sectional view schematically illustrating a part of the enlarged substrate holder 20 (a part A1 in FIG. 3). With reference to FIG. 3 and FIG. 5A, the substrate holder 20 according to this embodiment includes a first holding member 21 that holds an upper surface Wfb of the substrate Wf and a second holding member 22 that holds an outer peripheral edge of the lower surface Wfa of the substrate NW The first holding member 21 according to this embodiment has a circular plate shape. The second holding member 22 according to this embodiment has a ring shape. The substrate holder 20 holds the substrate Wf such that the substrate Wf is sandwiched between the first holding member 21 and the second holding member 22.

The first holding member 21 is connected to a lower side end portion of the rotation shaft 31. Specifically, the first holding member 21 according to this embodiment is connected to the rotation shaft 31 in a connection aspect (in a removable connection aspect) to be removable from/mountable to the rotation shaft 31. The second holding member 22 according to this embodiment is connected to a middle part of the rotation shaft 31 via a connecting member 23.

Note that the second holding member 22 according to this embodiment holds the outer peripheral edge of the lower surface Wfa of the substrate Wf via a sealing member 45. The sealing member 45 is a member for suppressing contact of the plating solution Ps with the contact members 40 described later when the substrate Wf is immersed in the plating solution Ps. The sealing member 45 according to this embodiment has a ring shape.

The contact members 40 are disposed on the substrate holder 20. Specifically, the contact members 40 according to this embodiment are disposed on the second holding member 22 of the substrate holder 20. The contact member 40 is a member that is in contact with the outer peripheral edge of the lower surface Wfa of the substrate Wf to supply electricity to the substrate Wf.

Figure 5B:
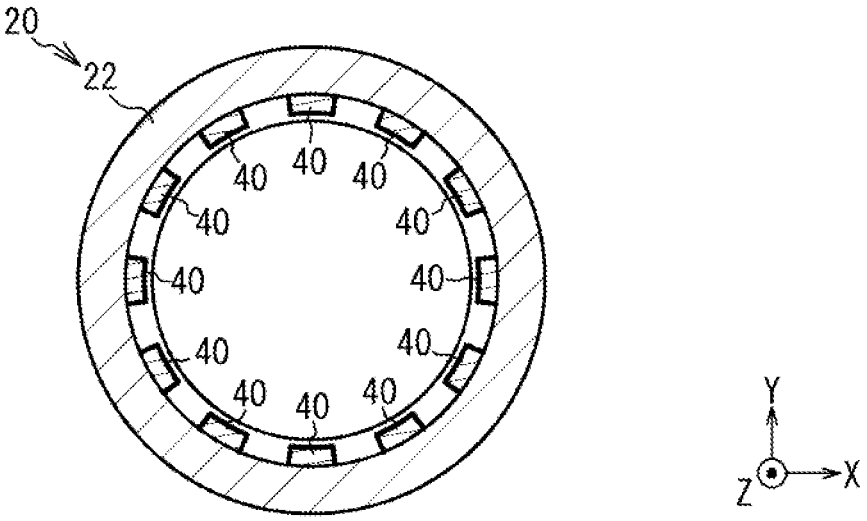
FIG. 5B is a schematic cross-sectional view of a peripheral configuration of contact members according to the embodiment.

FIG. 5B is a schematic cross-sectional view (a cross-sectional view taken along the line B1-B1) of a peripheral configuration of the contact members 40. Note that FIG. 5B omits the illustrations of the first holding member 21 and the substrate Wf. With reference to FIG. 5A and FIG. 5B, a plurality of the contact members 40 are disposed in a circumferential direction of the substrate holder 20 (specifically, a circumferential direction of the second holding member 22).

Specifically, the plurality of contact members 40 according to this embodiment are equally disposed in the circumferential direction of the substrate holder 20. The number of the plurality of contact members 40 is not particularly limited, and is 12 as one example in this embodiment. The plurality of contact members 40 are electrically connected to the energization device (not illustrated) to supply the electricity supplied from the energization device to the substrate Wf.

Figure 6:
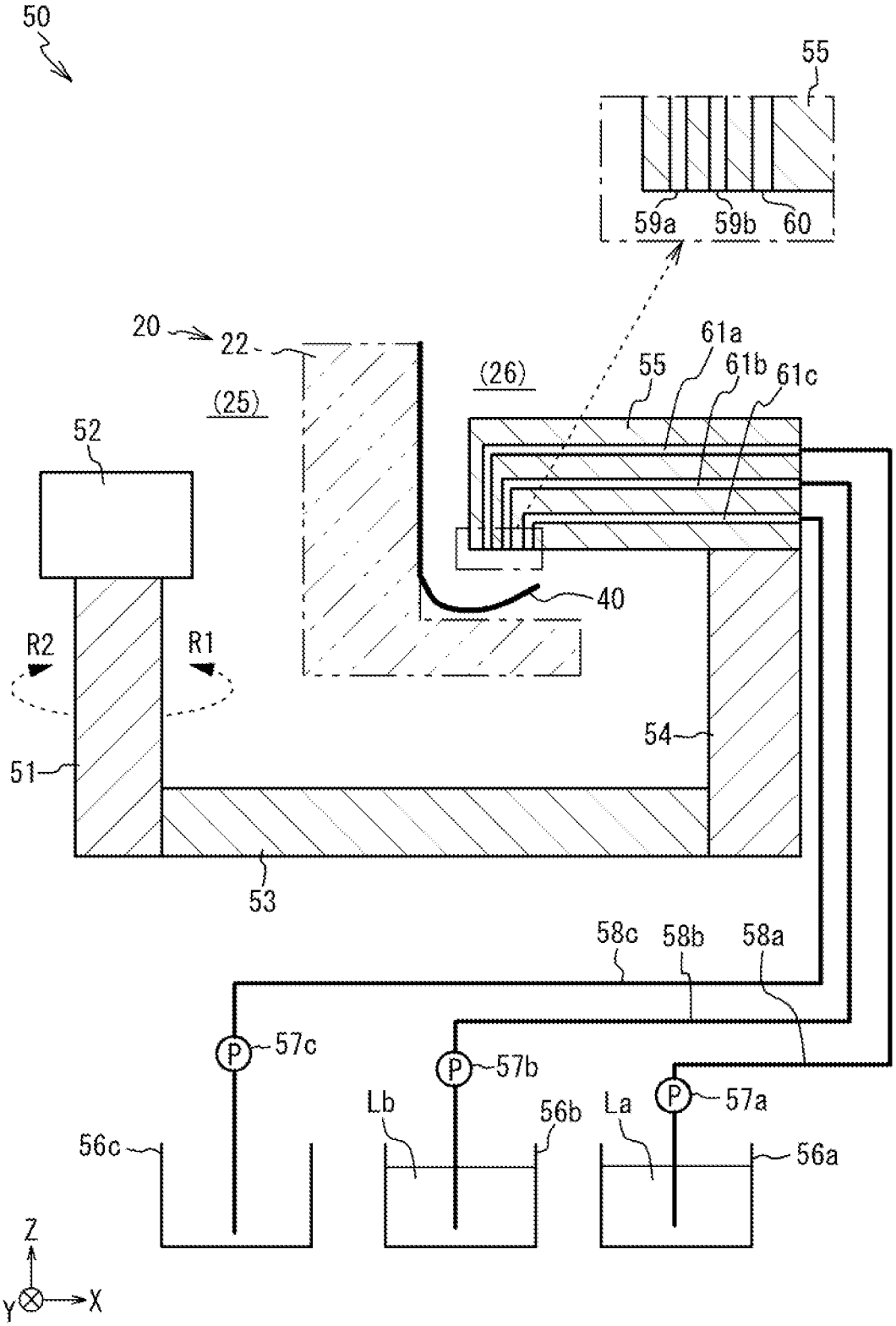
FIG. 6 is a drawing schematically illustrating an overall configuration of a cleaning device according to the embodiment.

Subsequently, the cleaning device 50 will be described. FIG. 6 is a drawing schematically illustrating an overall configuration of the cleaning device 50. The cleaning device 50 is a device for cleaning the contact members 40. Specifically, the cleaning device 50 according to this embodiment includes a pivot shaft 51, an actuator 52, a first arm 53, a second arm 54, a nozzle 55, tanks (a tank 56*a*, a tank 56*b*, and a tank 56*c*), pumps (a pump 57*a*, a pump 57*b*, and a pump 57*c*), and pipes (a pipe 58*a*, a pipe 58*h*, and a pipe 58*c*).

The pivot shaft 51 is disposed in an outer region of the substrate holder 20 in a radial direction of the substrate holder 20. Specifically, the pivot shaft 51 according to this embodiment is disposed in the outer region of the substrate holder 20 and the outer region of the plating tank 10. The pivot shaft 51 vertically extends. The pivot shaft 51 has an upper end connected to the actuator 52.

The actuator 52 is disposed outside the substrate holder 20 and in the outer region of the plating tank 10. The actuator 52 is controlled by the control module 800 to turn the pivot shaft 51 in a first rotation direction (R1) and a second rotation direction (R2). As the actuator 52, for example, an electric motor that can rotate in the first rotation direction (R1) and the second rotation direction (R2) can be used.

The first arm 53 is connected to a lower end of the pivot shaft 51 and horizontally extends. The second arm 54 extends upward from an end portion on a side opposite to a side connected to the pivot shaft 51 of the first arm 53. The first arm 53 and the second arm 54 have a function as connection arms connecting the pivot shaft 51 and the nozzle 55. When the pivot shaft 51 turns, the first arm 53 and the second arm 54 turn integrally with this pivot shaft 51. Lengths of the first arm 53 and the second arm 54 are set such that a discharge port and a suction port described later of the nozzle 55 are opposed to the contact members 40 when the nozzle 55 is positioned at a cleaning position described later.

The nozzle 55 is connected to an upper end of the second arm 54. The nozzle 55 includes at least one discharge port that discharges a "cleaning fluid" as a fluid for cleaning. Specifically, the nozzle 55 according to this embodiment includes the plurality of discharge ports, and includes two discharge ports (a discharge port 59*a* and a discharge port 59*b*) as one example. However, the number of discharge ports that the nozzle 55 includes is not limited to two, and may be larger than or smaller than two.

The discharge port 59*a* and the discharge port 59*b* are open downward. The discharge port 59*a* is configured to discharge a cleaning fluid La downward. The discharge port 59*b* is configured to discharge a cleaning fluid Lb, which is a different kind of cleaning fluid from the cleaning fluid La, downward, That is, the kinds of the cleaning fluids discharged from the respective discharge ports according to this embodiment differ from one another. The specific examples of these cleaning fluids will be described later.

The nozzle 55 according to this embodiment also includes a suction port 60. The suction port 60 is open downward and is configured to suction a fluid.

The nozzle 55 according to this embodiment internally includes an internal flow passage 61*a*, an internal flow passage 61*b*, and an internal flow passage 61*c*. The internal flow passage 61*a* has a downstream end communicating with the discharge port 59*a*, and the internal flow passage 61*b* has a downstream end communicating with the discharge port 59*b*. The internal flow passage 61*c* has an upstream end communicating with the suction port 60.

The internal flow passage 61*a* has an upstream end communicating with the tank 56*a* via the pipe 58*a*. The internal flow passage 61*b* has an upstream end communicating with the tank 56*b* via the pipe 58*b*. The internal flow passage 61*c* has a downstream end communicating with the tank 56*c* via the pipe 58*c*. In the pipe 58*a*, the pump 57*a* for pressure-feeding the cleaning fluid La stored in the tank 56*a* to the discharge port 59*a* is disposed. In the pipe 58*b*, the pump 57*h* for pressure-feeding the cleaning fluid Lb stored in the tank 56*b* to the discharge port 59*h* is disposed. In the pipe 58*c*, the pump 57*c* for pressure-feeding the fluid suctioned from the suction port 60 to the tank 56*c* is disposed. The control module 800 controls operations of the pump 57*a*, the pump 57*b*, and the pump 57*c*.

By the operation of the pump 57*a* in response to the command from the control module 800, the cleaning fluid La in the tank 56*a* passes through the pipe 58*a* and the internal flow passage 61*a* and is discharged from the discharge port 59*a*. Similarly, by the operation of the pump 57*b*, the cleaning fluid Lb in the tank 56*b* passes through the pipe 58*b* and the internal flow passage 61*b* and is discharged from the discharge port 59*b*. By the operation of the pump 57*c*, internal pressures of the pipe 58*c* and the internal flow passage 61*c* become negative pressures, and thus the fluid (specifically, the cleaning fluid after cleaning) is suctioned from the suction port 60. The fluid suctioned to this suction port 60 passes through the internal flow passage 61*c* and the pipe 58*c* and is stored in the tank 56*c*.

In this embodiment, as one example of the cleaning fluid La, neutral water (specifically, pure water) is used. Additionally, in this embodiment, acid water is used as one example of the cleaning fluid Lb. As one example of this acid water, water containing citric acid (citric acid water) is used in this embodiment. However, this is merely an example of the cleaning fluid La and the cleaning fluid Lb, and the specific kind of the cleaning fluid La or the cleaning fluid Lb is not limited to this.

Additionally, the cleaning fluid is not limited to liquid. A gas can be used as the cleaning fluid. As a specific example of this, for example, air can be used as any one of the cleaning fluid La and the cleaning fluid Lb. Note that the tank 56*a* is unnecessary in the case of using air as the cleaning fluid La. Similarly, the tank 56*b* is unnecessary in the case of using air as the cleaning fluid Lb.

Figure 7:
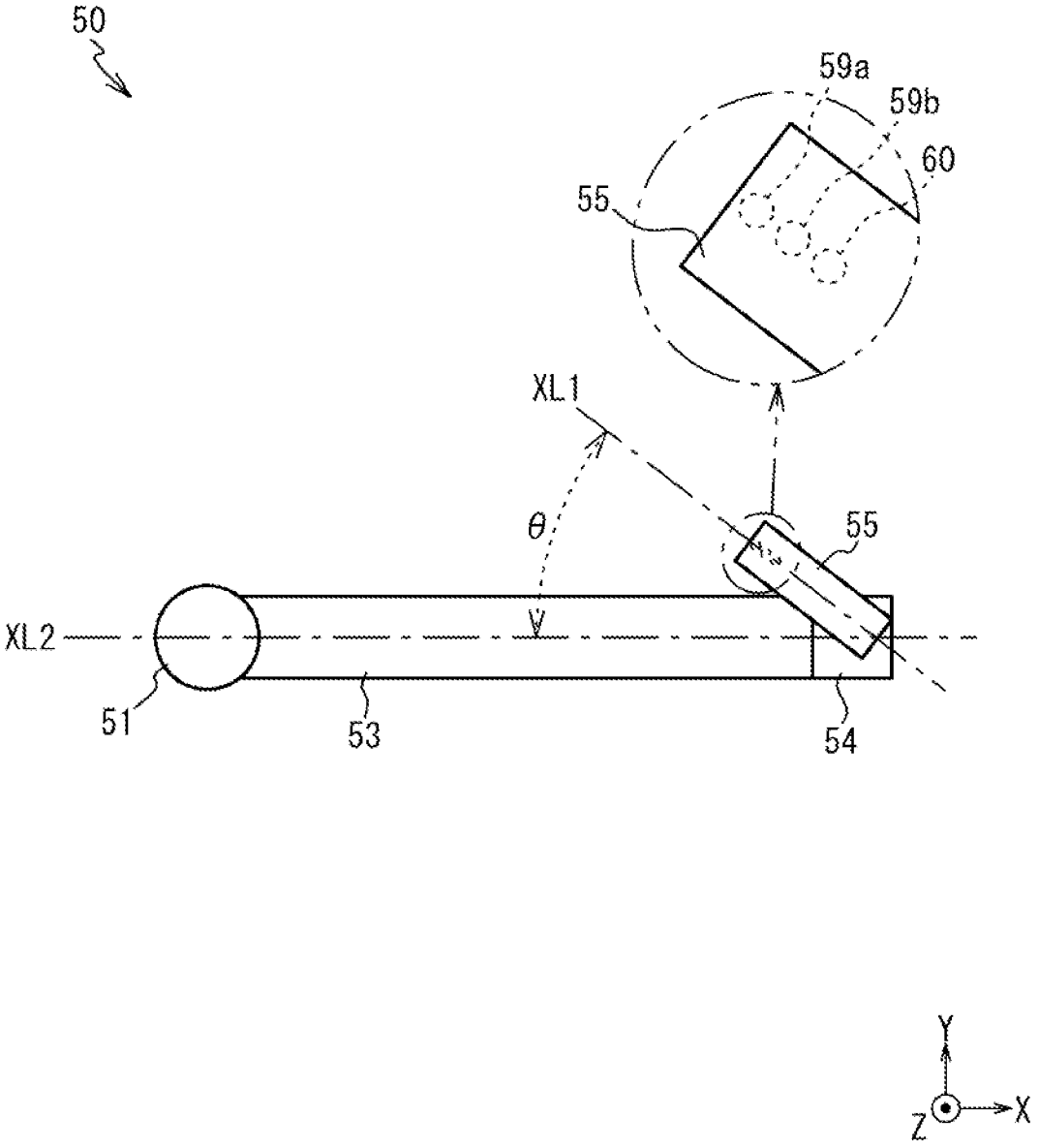
FIG. 7 is a schematic plan view of a configuration of a part of the cleaning device according to the embodiment.

FIG. 7 is a schematic plan view of a configuration of a part of the cleaning device 50. Note that FIG. 7 omits the illustration of the actuator 52 (the same applies to FIG. 8 described later), In FIG. 7, the nozzle 55 is located at an elevating position described later. The nozzle 55 according to this embodiment has a shape (specifically, a rectangular shape) of extending toward a side of the pivot shaft 51 having a starting point at the upper end of the second arm 54. Then, in plan view (or top view), an angle θ formed by an axis line XL1 extending in a longitudinal direction of the nozzle 55 and an axis line XL2 extending in a longitudinal direction of the first arm 53 (an angle formed when viewed from the side of the pivot shaft 51) is an angle larger than 0 degrees (°) and less than 90 degrees (°), and specifically, an angle of 10 degrees or more and 70 degrees or less. More specifically, the formed angle θ is an angle of 10 degrees or more and 60 degrees or less, and in more detail, an angle of 10 degrees or more and 50 degrees or less.

As described above, the formed angle θ being the angle of 10 degrees or more and 70 degrees or less allows easily applying the cleaning fluid discharged from the discharge port 59*a* or 59*h* of the nozzle 55 to the contact member 40 (see FIG. 8 described later), This allows effectively cleaning the contact members 40. However, the formed angle θ described above is merely an example, and an appropriate value is preferably used as the formed angle θ according to, for example, the length of the first arm 53 and the length of the nozzle 55.

With reference to FIG. 6 and FIG. 7, the discharge port 59*a*, the discharge port 59*b*, and the suction port 60 according to this embodiment are arranged in a direction of the axis line XL1 of the nozzle 55. However, the arrangement aspect of the discharge port 59*a*, the discharge port 59*b*, and the suction port 60 is not limited to this. As another example, the discharge port 59*a*, the discharge port 59*b*, and the suction port 60 may be arranged, for example, in a direction perpendicular to the axis line XL1 of the nozzle 55 (that is, a width direction of the nozzle 55).

Figure 8:
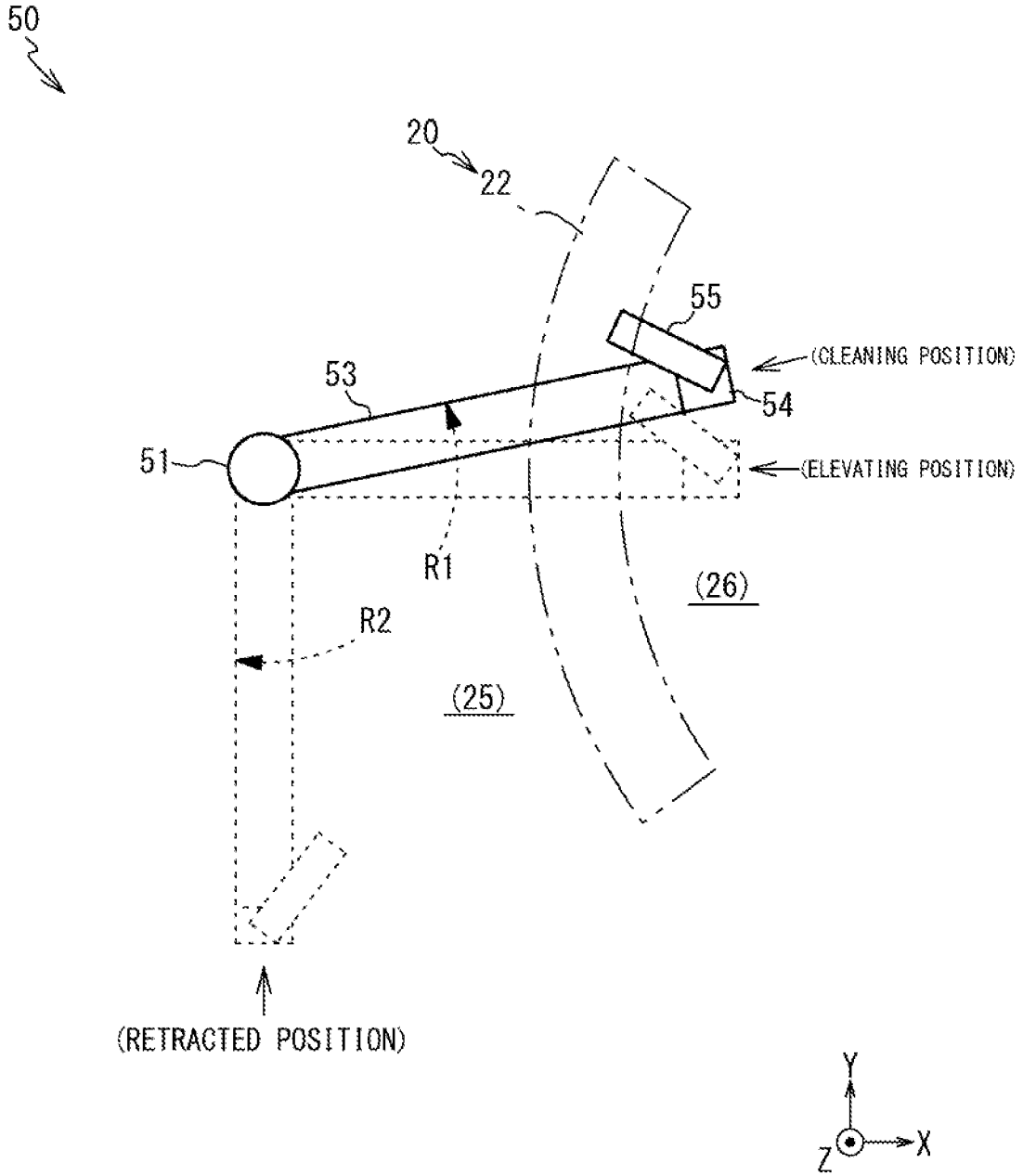
FIG. 8 is a plan view schematically illustrating a state of movement of a nozzle according to the embodiment.

FIG. 8 is a plan view schematically illustrating a state of movement of the nozzle 55. In the cleaning device 50 according to this embodiment, the actuator 52 that has received the command from the control module 800 turns the pivot shaft 51 in the first rotation direction (R1) and the second rotation direction (R2) to move the nozzle 55 between an outer region in the radial direction of the substrate holder 20 (namely, an outside region 25) and an inner region in the radial direction of the substrate holder 20 (namely, an inside region 26). In performing the process of cleaning the contact members 40, the nozzle 55 being disposed in the inside region 26 of the substrate holder 20 allows effectively cleaning the inside region 26 of the substrate holder 20 including the contact members 40 with the cleaning fluid and effectively suctioning the cleaning fluid as described later.

Specifically, the control module 800 according to this embodiment moves the nozzle 55 to a retracted position in the outside region 25 of the substrate holder 20 in usual operation. In this embodiment, this retracted position is located in the outside region 25 of the substrate holder 20 and also located in an outside region of the plating tank 10. The plating process of the substrate Wf described above in FIG. 4 is thus performed in the state of the nozzle 55 being at the retracted position.

Figure 9:
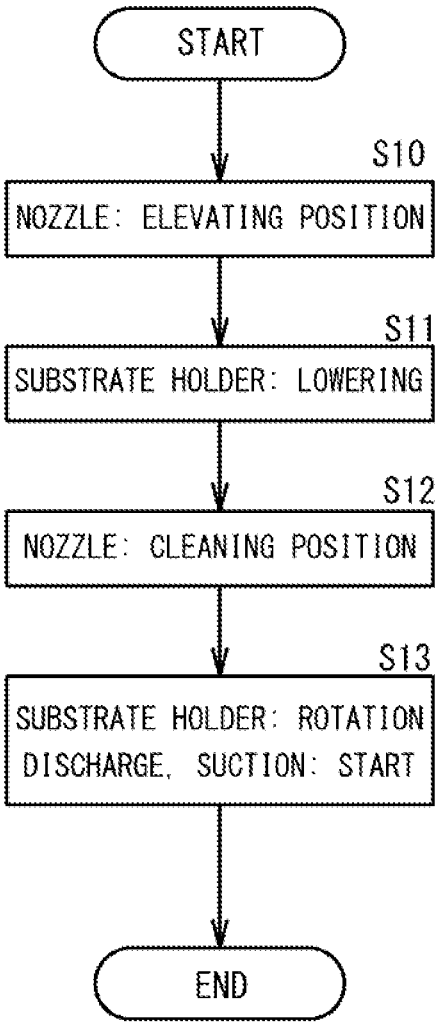
FIG. 9 is an example of a flowchart depicting a sequence of control performed when performing a contact member cleaning process according to the embodiment.

On the other hand, the control nodule 800 performs a sequence of control described later to perform the process of cleaning the contact members 40 (referred to as a "contact member cleaning process"). FIG. 9 is an example of a flowchart depicting a sequence of control performed when performing the contact member cleaning process, Respective steps of the flowchart of FIG. 9 are performed based on the command of the program in the storage section 802 by specifically the CPU 801 in the control module 800. With reference to FIG. and FIG. 9, the following will describe the contact member cleaning process.

First, the contact member cleaning process according to this embodiment is performed while the substrate Wf is removed from the substrate holder 20. Furthermore, in this embodiment, the contact member cleaning process is performed while the first holding member 21 of the substrate holder 20 is removed from the plating module 400.

For example, when a "cleaning start command" as a control command to start the contact member cleaning process is issued, the control module 800 starts the flowchart of FIG. 9. An example of this is as follows. For example, when an operation switch (this is an operation switch operated by a user) for transmitting the cleaning start command to the control module 800 is operated, the cleaning start command is transmitted to the control module 800, and the control module 800 receives this transmitted cleaning start command, the control module 800 starts the flowchart of FIG. 9.

At Step S10 of FIG. 9, the control module 800 controls the actuator 52 and turns the pivot shaft 51 in the first rotation direction (R1). Thus, the control module 800 moves the nozzle 55 moved to the retracted position in the outside region 25 to the "elevating position" as a position where the nozzle 55 does not interfere with the substrate holder 20 in the inside region 26 of the substrate holder 20.

Next, the control module 800 lowers the substrate holder 20 by the elevating mechanism 36 to position the contact members 40 downward with respect to the discharge ports 59*a* and 59*b* and the suction port 60 of the nozzle 55 (Step S11).

Next, the control module 800 controls the actuator 52 to turn the pivot shaft 51 in the first rotation direction (R1), and thus moves the nozzle 55 to the "cleaning position" where the discharge ports 59*a* and 59*b* and the suction port 60 are opposed to the contact members 40 in the inside region 26 (Step S12).

Next, the control module 800 rotates the substrate holder 20 by the rotation mechanism 30 and starts operating the pump 57*a*, the pump 57*b*, and the pump 57*c* to start discharging the cleaning fluid La from the discharge port 59*a*, discharging the cleaning fluid Lb from the discharge port 59*b*, and suctioning the fluid from the suction port 60 (Step S13). This allows starting the discharge of the cleaning fluid La from the discharge port 59*a*, the discharge of the cleaning fluid Lb from the discharge port 59*b*, and the suction of the fluid from the suction port 60 while rotating the contact members 40.

At this step S13, while the contact members 40 are rotated, the cleaning fluid La is discharged from the discharge port 59*a* and the cleaning fluid Lb is discharged from the discharge port 59*b*. This allows effectively applying the cleaning fluid La discharged from the discharge port 59*a* and the cleaning fluid Lb discharged from the discharge port 59*h* to the contact members 40 to clean the contact members 40.

According to this embodiment, as described above, the nozzle 55 includes not only the discharge ports but also the suction port 60 and the fluid is suctioned from the suction port 60 at Step S13. Therefore, the cleaning fluid after cleaning attached to the contact members 40 can be suctioned from the suction port 60. Accordingly, it is possible to suppress leaving the cleaning fluid after cleaning (the dirty cleaning fluid) on the contact member 40 over a long period of time. As a result, the contact member 40 can be in a clean state early.

Note that the control module 800 according to this embodiment discharges the cleaning fluid La from the discharge port 59*a*, discharges the cleaning fluid Lb from the discharge port 59*b*, and suctions the fluid from the suction port 60 simultaneously at Step S13, but the operation is not limited to this. At Step S13, the respective discharge of the cleaning fluid La from the discharge port 59*a*, discharge of the cleaning fluid Lb from the discharge port 59*b*, and suction of the fluid from the suction port 60 may be performed at different timings.

An example of this is as follows. For example, at Step S13, the cleaning fluid La may be discharged from the discharge port 59*a* first, the cleaning fluid Lb may be discharged from the discharge port 59*b* next, and the fluid may be suctioned from the suction port 60 next. Alternatively, at Step S13, the cleaning fluid Lb may be discharged from the discharge port 59*b* first, the cleaning fluid La may be discharged from the discharge port 59*a* next, and the fluid may be suctioned from the suction port 60 next. Alternatively, the discharges and the suction may be performed in an order other than them.

Note that a condition to terminate the control at Step S13 is not particularly limited. For example, after a preset predetermined period passes from the start of the control at Step S13, the control module 800 may terminate the control at Step S13. That is, in this case, Step S13 is performed for the predetermined period.

Alternatively, the control module 800 may terminate the control at Step S13 when a "cleaning end command" as a control command to terminate the contact member cleaning-process is issued. An example of this is as follows. For example, when the operation switch for transmitting the cleaning end command to the control module 800 is operated, the cleaning end command is transmitted to the control module 800, and the control module 800 receives this transmitted cleaning end command, the control module 800 may terminate the control at Step S13.

Additionally, to terminate the control at Step S13, the control module 800 according to this embodiment specifically performs the following control. First, the control module 800 stops the rotation of the substrate holder 20 by the rotation mechanism 30 and stops the operations of the pump 57*a*, the pump 57*b*, and the pump 57*c* to stop discharging the cleaning fluids from the discharge ports 59*a* and 59*b* and suctioning the cleaning fluid from the suction port 60. Next, the control module 800 rotates the pivot shaft 51 in the second rotation direction (R2) to return the nozzle 55 to the elevating position. Next, the control module 800 raises the substrate holder 20 above the nozzle 55 by the elevating mechanism 36. Next, the control module 800 rotates the pivot shaft 51 in the second rotation direction (R2) to return the nozzle 55 to the retracted position in the outside region 25.

Note that a cleaning method of the contact member of the plating apparatus 1000 according to this embodiment is achieved by the plating apparatus 1000 described above. Accordingly, to omit the overlapping description, the description of this cleaning method of the contact member swill be omitted.

According to this embodiment described above, the cleaning device 50 constituted in a simple structure can clean the contact members 40 as described above. This allows suppressing deterioration of plating quality of the substrate Wf caused by dirt of the contact members 40 while a cost of the cleaning device 50 is reduced.

According to this embodiment, with the two arms, the first arm 53 and the second arm 54, the nozzle 55 can be disposed at a position farther from a connection position of the first arm 53 in the pivot shaft 51. This allows effectively cleaning the contact members 40.

According to this embodiment, turning the pivot shaft 51 allows turning movement of the nozzle 55, and therefore the cleaned part with the cleaning fluid can be easily changed. This allows easily cleaning a wide range.

Note that during cleaning the contact members 40 in the above-described contact member cleaning process (during performing Step S13), that is, during discharging the cleaning fluid from the discharge port while the substrate holder 20 is rotated, the contact members 40 may be cleaned while the pivot shaft 51 is alternately turned in the first rotation direction (R1) and the second rotation direction (R2). According to this configuration, while the nozzle 55 is swung around the pivot shaft 51, the contact members 40 can be cleaned. This allows effectively cleaning the contact members 40.

Figure 10:
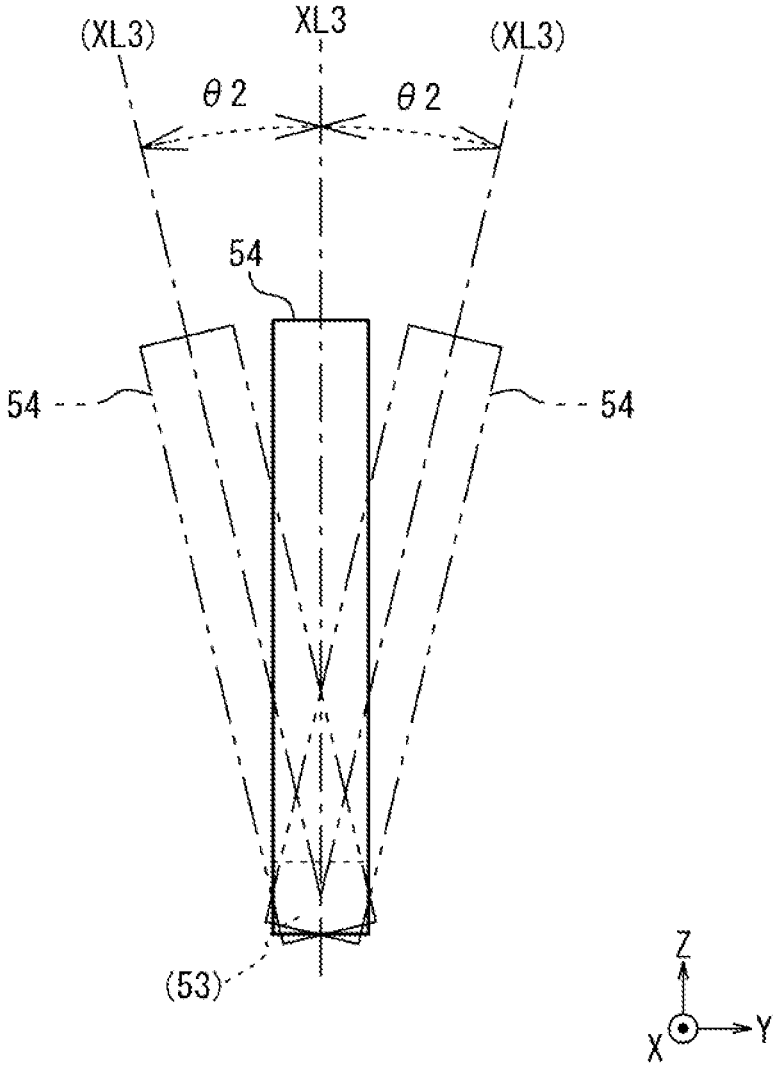
FIG. 10 is a schematic diagram for describing a modification of a second arm according to the embodiment.

In the above-described embodiment, the second arm 54 is configured so as not to be inclined having a starting point at a part connected to the first arm 53 in the second arm 54, but the configuration is not limited to this. FIG. 10 is a schematic diagram for describing a modification of the second arm 54. Specifically, FIG. 10 schematically illustrates a state in which the second arm 54 at the elevating position is viewed from a direction of the axis line XL2 of the first arm 53. For example, the second arm 54 may be connected to an end portion of the first arm 53 so as to be inclinable having the starting point at the part connected to the first arm 53 in the second arm 54 (that is, the end portion on the side opposite to the side connected to the pivot shaft 51 of the first arm 53). This configuration allows inclining the second arm 54 to easily adjust a discharge direction of the cleaning fluid from the discharge port of the nozzle 55.

Specifically, the second arm 54 may be connected to the end portion of the first arm 53 to be inclinable at a predetermined angle (θ2) with respect to the vertical direction having the starting point at the part connected to the first arm 53 in the second arm 54. As this predetermined angle (θ2), for example, an angle larger than 0 degrees (°) and smaller than 20 degrees (°) can be used.

More specifically, the second arm 54 illustrated in FIG. 10 as an example is connected to the end portion of the first arm 53 such that an axis line XL3 extending in a longitudinal direction of the second arm 54 is inclinable at the predetermined angle (θ2) with respect to the vertical direction (a direction perpendicular to the ground) toward one side and/or the other side having the starting point at the part connected to the first arm 53 in the second arm 54 as viewed from the direction of the axis line XL2 of the first arm 53.

Note that the second arm 54 may be connected to the end portion of the first arm 53 such that the axis line XL3 extending in the longitudinal direction of the second arm 54 is inclinable at the predetermined angle (θ2) with respect to the vertical direction having the starting point at the part connected to the first arm 53 in the second arm 54 as viewed from a direction perpendicular to the axis line XL2 of the first arm 53 and the horizontal direction (as one example, the Y direction in FIG. 6 and FIG. 10).

Although the embodiments according to the present invention have been described in detail above, the present invention is not limited to such embodiments, and further various kinds of modifications and changes are possible within the scope of the gist of the present invention described in the claims.

REFERENCE SIGNS LIST

11 . . . anode
20 . . . substrate holder
21 . . . first holding member
22 . . . second holding member
25 . . . outside region (outer region)
26 . . . inside region (inner region)
30 . . . rotation mechanism
36 . . . elevating mechanism
40 . . . contact member
50 . . . cleaning device
51 . . . pivot shaft
52 . . . actuator
53 . . . first arm
54 . . . second arm
55 . . . nozzle
59*a*, 59*b* . . . discharge port
60 . . . suction port
800 . . . control module
1000 . . . plating apparatus
R1 . . . first rotation direction
R2 . . . second rotation direction
Wf . . . substrate
Wfa . . . lower surface
Wfb . . . upper surface
Ps . . . plating solution
La, Lb . . . cleaning fluid

The invention claimed is:

1. A plating apparatus comprising:

a plating tank;

a substrate holder disposed above an anode disposed inside the plating tank, the substrate holder being configured to hold a substrate as a cathode;

a rotation mechanism configured to rotate the substrate holder;

an elevating mechanism configured to raise and lower the substrate holder;

a contact member disposed on the substrate holder, the contact member being in contact with an outer peripheral edge of a lower surface of the substrate to supply electricity to the substrate;

a cleaning device configured to clean the contact member, wherein the cleaning device includes:

a pivot shaft disposed in an outer region in a radial direction of the substrate holder and extending in a vertical direction;

a first arm connected to the pivot shaft and extending in a horizontal direction;

a second arm extending upward from an end portion on a side opposite to a side connected to the pivot shaft of the first arm; and a nozzle connected to an upper end of the second arm and including at least one discharge port that is open downward and discharges a cleaning fluid directly to the contact member, and the cleaning device is configured to clean the contact member by applying the cleaning fluid discharged from the discharge port to the contact member; and a control module configured to control the rotation mechanism, the elevating mechanism, and the cleaning device, wherein when performing a contact member cleaning process that cleans the contact member, the control module turns the pivot shaft to move the nozzle that has been below the substrate holder and has moved to the outer region in the radial direction of the substrate holder in plan view to an elevating position that is below the substrate holder and is in an inner region in the radial direction of the substrate holder in plan view, subsequently lowers the substrate holder by the elevating mechanism to locate the contact member below the discharge port, subsequently turns the pivot shaft to move the nozzle to a cleaning position where the discharge port is opposed to the contact member in the inner region, and subsequently discharges the cleaning fluid from the discharge port while rotating the substrate holder by the rotation mechanism.

2. The plating apparatus according to claim 1, wherein the nozzle extends from the upper end of the second arm toward a side of the pivot shaft, and an angle formed by an axis line extending in a longitudinal direction of the nozzle and an axis line extending in a longitudinal direction of the first arm in plan view is 10 degrees or more and 70 degrees or less.

3. The plating apparatus according to claim 1, wherein during discharging the cleaning fluid from the discharge port while the substrate holder is rotated by the rotation mechanism, the control module alternately turns the pivot shaft in a first rotation direction and a second rotation direction opposite to the first rotation direction.

4. The plating apparatus according to claim 1, wherein the second arm is connected to the end portion of the first arm to be inclinable around a part connected to the first arm in the second arm.

5. The plating apparatus according to claim 1, wherein the at least one discharge port includes a plurality of discharge ports, and kinds of the cleaning fluids discharged from the respective discharge ports are mutually different.

6. The plating apparatus according to claim 1, wherein the nozzle further includes a suction port that is open downward and suctions a fluid.

7. The plating apparatus according to claim 1, wherein the substrate holder includes a first holding member and a second holding member, the first holding member holds an upper surface of the substrate, and the second holding member holds the outer peripheral edge of the lower surface of the substrate, and the contact member is disposed on the second holding member.

8. A cleaning method of a contact member of a plating apparatus, wherein the plating apparatus includes a plating tank, a substrate holder, a contact member, and a cleaning device, the substrate holder is disposed above an anode disposed inside the plating tank, the substrate holder is configured to hold a substrate as a cathode, the contact member is disposed on the substrate holder, the contact member is in contact with an outer peripheral edge of a lower surface of the substrate to supply electricity to the substrate, and the cleaning device is configured to clean the contact member, the cleaning device includes a pivot shaft, a first arm, a second arm, and a nozzle, the pivot shaft is disposed in an outer region in a radial direction of the substrate holder and extends in a vertical direction, the first arm is connected to the pivot shaft and extends in a horizontal direction, the second arm extends upward from an end portion on a side opposite to a side connected to the pivot shaft of the first arm, the nozzle is connected to an upper end of the second arm, and the nozzle includes at least one discharge port that is open downward and discharges a cleaning fluid directly to the contact member, and the cleaning method of the contact member comprises:

turning the pivot shaft to move the nozzle that has been below the substrate holder and has moved to the outer region in the radial direction of the substrate holder in plan view to an elevating position that is below the substrate holder and is in an inner region in the radial direction of the substrate holder in plan view;

subsequently lowering the substrate holder to locate the contact member below the discharge port;

subsequently turning the pivot shaft to move the nozzle to a cleaning position where the discharge port is opposed to the contact member in the inner region; and subsequently discharging the cleaning fluid from the discharge port while rotating the substrate holder.

* * * * *